US009301585B2

(12) United States Patent
Fulmer

(10) Patent No.: US 9,301,585 B2
(45) Date of Patent: Apr. 5, 2016

(54) BAG ASSEMBLY AND METHOD OF PROVIDING THE SAME

(76) Inventor: Robert Fulmer, Chicago, IL (US)

( * ) Notice: Subject to any disclaimer, the term of this patent is extended or adjusted under 35 U.S.C. 154(b) by 984 days.

(21) Appl. No.: 13/407,528

(22) Filed: Feb. 28, 2012

(65) Prior Publication Data

US 2013/0223769 A1 Aug. 29, 2013

(51) Int. Cl.

| | |
|---|---|
| ***A45C 13/04*** | (2006.01) |
| ***A45C 5/00*** | (2006.01) |
| ***A45C 13/26*** | (2006.01) |
| ***A45C 13/28*** | (2006.01) |
| *A45C 11/00* | (2006.01) |

(52) U.S. Cl.

CPC ..... *A45C 13/04* (2013.01); *A45C 5/005* (2013.01); *A45C 13/26* (2013.01); *A45C 13/28* (2013.01); *A45C 11/008* (2013.01); *A45C 2200/15* (2013.01); *Y10T 29/49826* (2015.01)

(58) Field of Classification Search

CPC ..... A45C 5/005; A45C 2011/007; A45C 11/008; A45C 11/16; A45C 13/26; A45C 13/28; A47F 5/04; A47F 5/05; A47F 3/00; A47F 3/004; A47F 3/005; A47F 3/007; A47F 3/10; A47F 2003/008; B65D 57/00

USPC ..... 312/140.4, 283, 249.2; 383/41, 104, 383/121.1; 248/683, 205.5, 309.3, 363, 248/537, 206.2, 362, 205.8; 211/77, 78, 211/85.15

See application file for complete search history.

(56) References Cited

U.S. PATENT DOCUMENTS

| | | | | |
|---|---|---|---|---|
| 1,772,304 | A | 8/1930 | Bosque | |
| 1,975,291 | A | 10/1934 | Ritter, Jr. | |
| 1,989,073 | A | 1/1935 | Bosque | |
| 2,605,989 | A | 8/1952 | Luft | |
| 2,876,980 | A | 3/1959 | Salter | |
| 3,568,899 | A | 3/1971 | Rosenberg | |
| 3,692,376 | A * | 9/1972 | McKinsey et al. | 312/9.46 |
| 4,531,645 | A | 7/1985 | Tisbo et al. | |
| 4,611,716 | A | 9/1986 | Sorlien | |
| 4,738,340 | A | 4/1988 | Crespi | |
| 5,000,513 | A | 3/1991 | Schmidt | |
| 5,577,611 | A | 11/1996 | Greenall | |
| 6,568,899 | B1 | 5/2003 | Kuribayashi et al. | |
| 6,749,273 | B1 * | 6/2004 | Peterson | 312/3 |
| 7,735,639 | B1 * | 6/2010 | De Mare | 206/5 |
| 2008/0163591 | A1 * | 7/2008 | Dewolf et al. | 53/474 |
| 2009/0236019 | A1 * | 9/2009 | Maruzzo | 150/154 |

* cited by examiner

*Primary Examiner* — Jes F Pascua
*Assistant Examiner* — Nina Attel
(74) *Attorney, Agent, or Firm* — Barnes & Thornburg LLP; Mark J. Nahnsen

(57) ABSTRACT

A bag assembly includes a base member configured to be releasably coupled to a horizontal surface to maintain a position of the bag assembly with respect to the surface. The bag assembly further includes a support member attached to and extending outwardly from the base member. A bag member is disposed adjacent the support shaft and includes at least one compartment, the compartment having at least two openings for access into the compartment. The bag member rotates about the support shaft to access the at least two openings.

5 Claims, 6 Drawing Sheets

BAG ASSEMBLY AND METHOD OF PROVIDING THE SAME

BACKGROUND

1. Field of the Disclosure

The present disclosure relates generally to a bag assembly, and more particularly, to a bag assembly that can be attached to a surface and/or that rotates.

2. Description of the Background

People have been using small bags to contain their toiletries and/or other items, such as jewelry, small electronics, and/or other personal items, in the home or during travel, for years. Some of such bags include a generally planar rear wall, side walls that extend outwardly from the rear wall and curve into a slightly curved front wall. The front wall includes a zipper that extends in a U-shape beginning at an upper left side thereof, continuing to a lower central portion thereof, and terminating at an upper right side thereof. The zipper allows access to an interior of the bag, which contains a number of pockets for containment of bottles, tubes, brushes, or any other personal items.

Other toiletry bags include a regular bag with a generally square-shaped, rectangular, or circular cross-sectional with a zipper on one side of the bag. Personal items are placed inside the bags and the zipper is closed to contain the items and/or prevent the personal items from moving around, for example, in a user's luggage.

One of the shortfalls in current travel and toiletry bags is that it is difficult to position the bags in an upright manner to easily access items and/or prevent leakage of liquids or gelatinous items within the bags. Another shortfall is that it is oftentimes difficult to locate and/or extract items from the bags, as there is little organization to such bags.

SUMMARY

According to one aspect of the present disclosure, a bag assembly includes a base member configured to be releasably coupled to a horizontal surface to maintain a position of the bag assembly with respect to the surface. The bag assembly further includes a support member attached to and extending outwardly from the base member. A bag member is disposed adjacent the support shaft and includes at least one compartment, the compartment having at least two openings for access into the compartment. The bag member rotates about the support shaft to access the at least two openings.

In a different aspect of the present disclosure, a method of providing a bag assembly includes the step of providing a base member, a support shaft attached to and extending outwardly from the base member, and a bag member disposed adjacent the support shaft. The bag member has at least one compartment, the compartment having at least two openings for access into the compartment. The method further includes the steps of allowing for releasable coupling of the base member to a horizontal surface to maintain a position of the bag assembly with respect to the surface and allowing the bag member to rotate about the support shaft to access the at least two openings.

BRIEF DESCRIPTION OF THE DRAWINGS

Other aspects and advantages of the present disclosure will become apparent upon consideration of the following detailed description, wherein similar structures have like or similar reference numerals.

DETAILED DESCRIPTION

Figure 1:
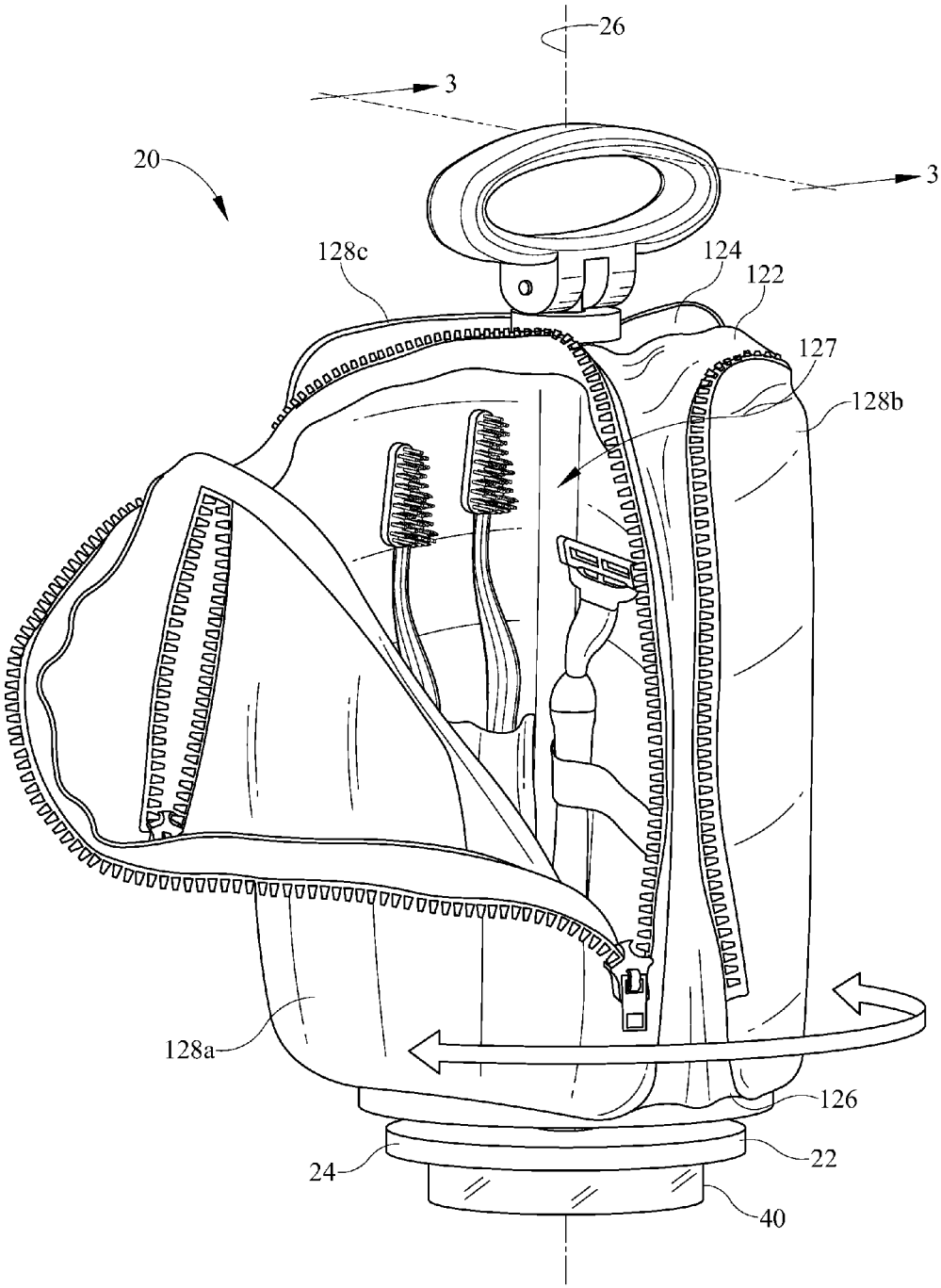
FIG. 1 is a top, isometric view of a first embodiment of a bag assembly having a rotatable bag and further having a handle disposed in a first position.

The present disclosure is directed to a bag assembly. While the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

Referring to FIGS. 1-4, a bag assembly 20 includes a base member 22 including a planar support plate 24 having a downwardly extending cylindrical member 26 with an outwardly extending annular flange 28. An annular groove 30 is formed between a lower surface 32 of the support plate 24 and the annular flange 28. The base member 22 further includes a suction cup member 34 having a central suction cup 36 with a thickened central section 38. A cylindrical wall 40 extends upwardly from an outer annular edge 42 of an upper surface 44 of the suction cup 36 and an annular projection 46 extends inwardly from an end 48 of the cylindrical wall 40. During assembly, the suction cup member 34 is attached to the base member 22 by inserting the annular projection 46 of the suction cup member 34 into the annular groove 30 of base member 22. While the base member 22 is preferably made of plastic, the base member 22 may be made of any material known in the art. The suction cup 36 may alternatively be attached to the base member 22 in any manner known in the art.

Figure 3:
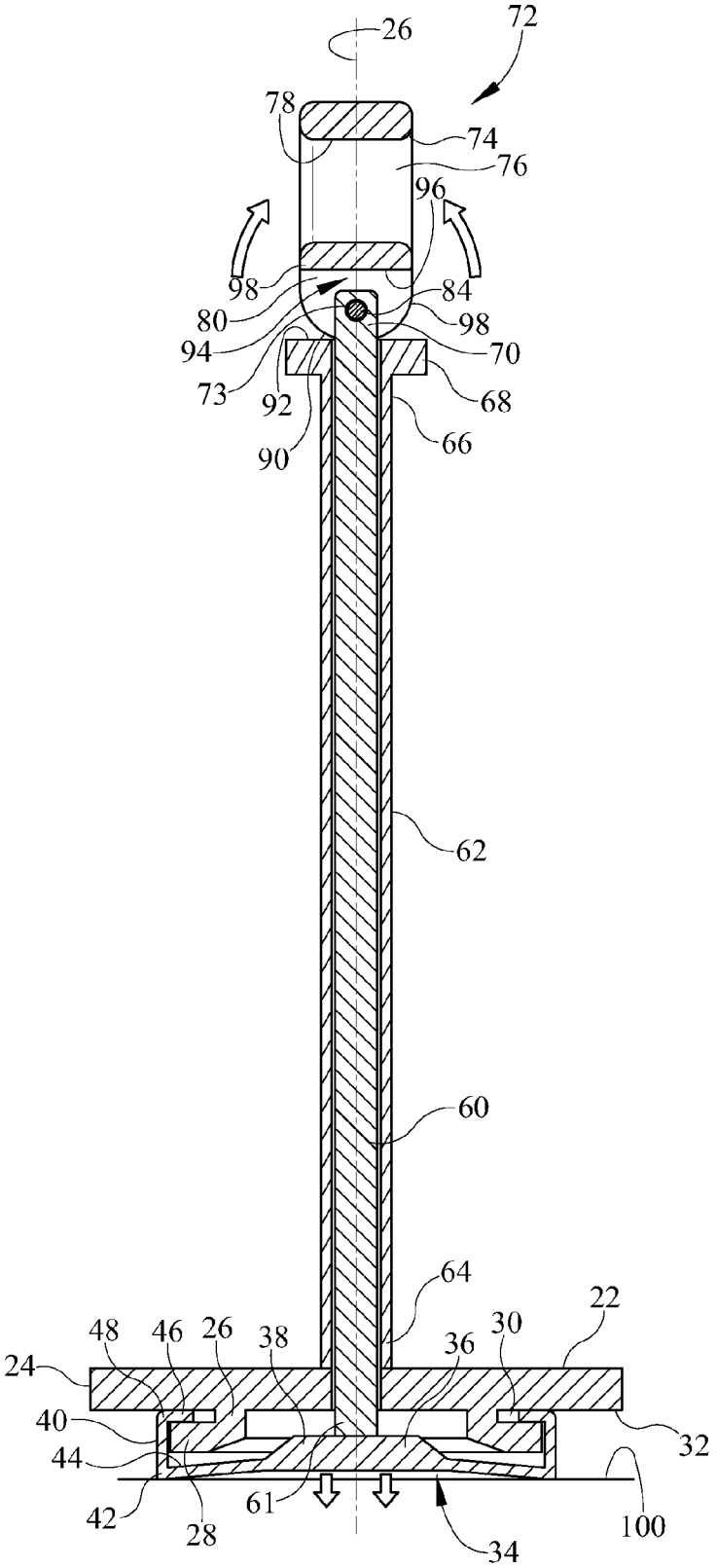
FIG. 3 is cross-sectional view taken generally along the lines 3-3 of FIG. 1 and depicting the handle in the first position.
Figure 4:
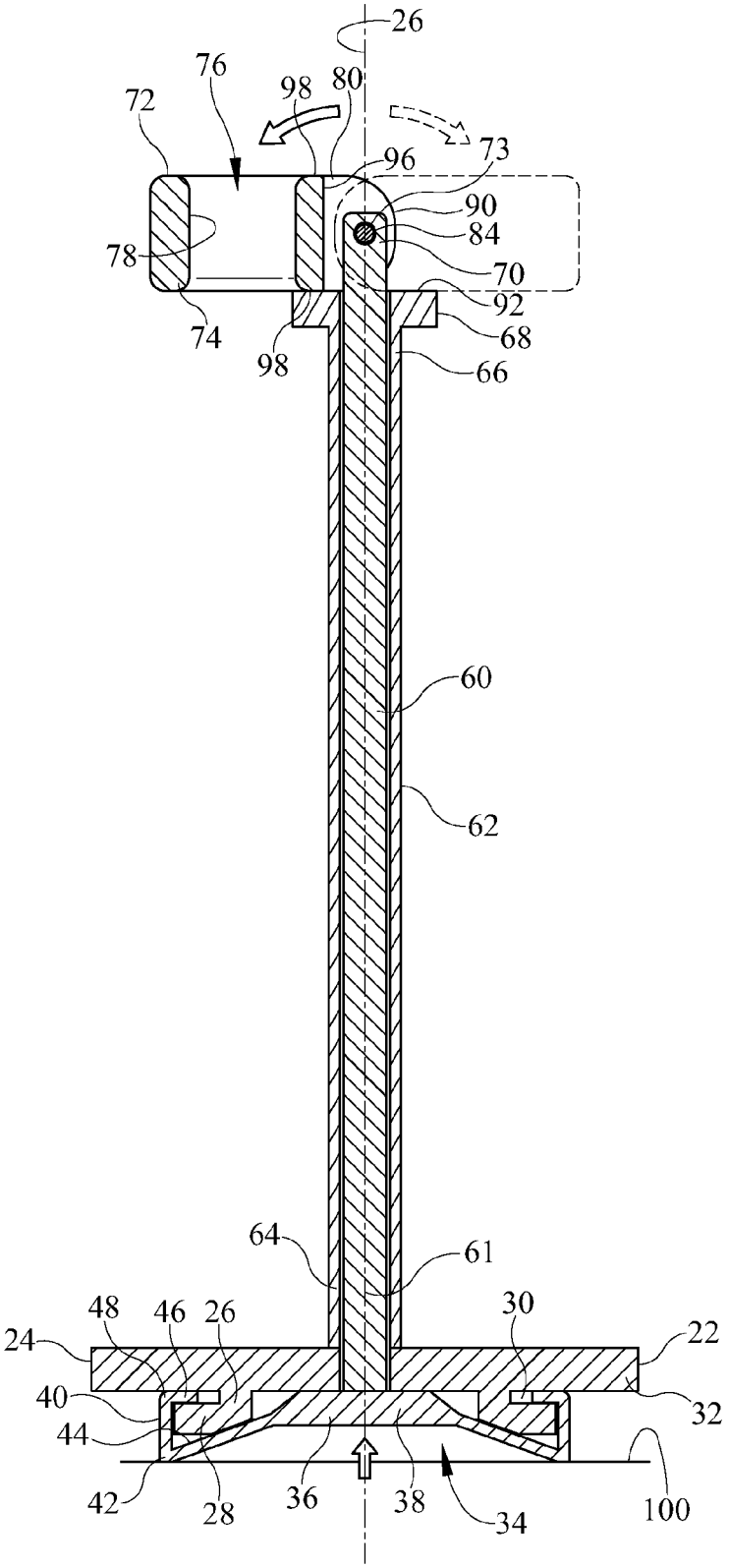
FIG. 4 is a cross-sectional view taken generally along the lines 3-3 of FIG. 1 and depicting the handle in the second position.

Referring to FIGS. 3 and 4, the bag assembly 20 further includes a support shaft 60 connected to the upper surface 44 of the suction cup member 34 at the thickened central section 38. A lower end 61 of the support shaft 60 and suction cup member 34 may be connected in any manner known in the art, including, but not limited to, a threaded connection, adhesive, one or more fasteners, a friction fit, an interference fit, and the like and combinations thereof. Optionally, the support shaft 60 may be integral with the suction cup member 34. The bag assembly 20 further includes a tubular member 62 disposed around the support shaft 60. A lower end 64 of the tubular member 62 is disposed adjacent a top surface of the support plate 24. The tubular member 62 and support plate 24 may be permanently or removably connected or may not be connected. The tubular member 62 and support plate 24, if connected, may be connected in any manner known in the art, including, but not limited to, adhesive, one or more fasteners, a friction fit, an interference fit, and the like, and combinations thereof. Still optionally, the tubular member 62 and the support plate 24 may be a single integral piece. As seen in FIGS. 3 and 4, an annular flange 68 extends outwardly from an upper end 66 of the tubular member 62. The support shaft 60 and tubular member 62 are preferably plastic, although, any material known the art may be utilized.

Figure 5:
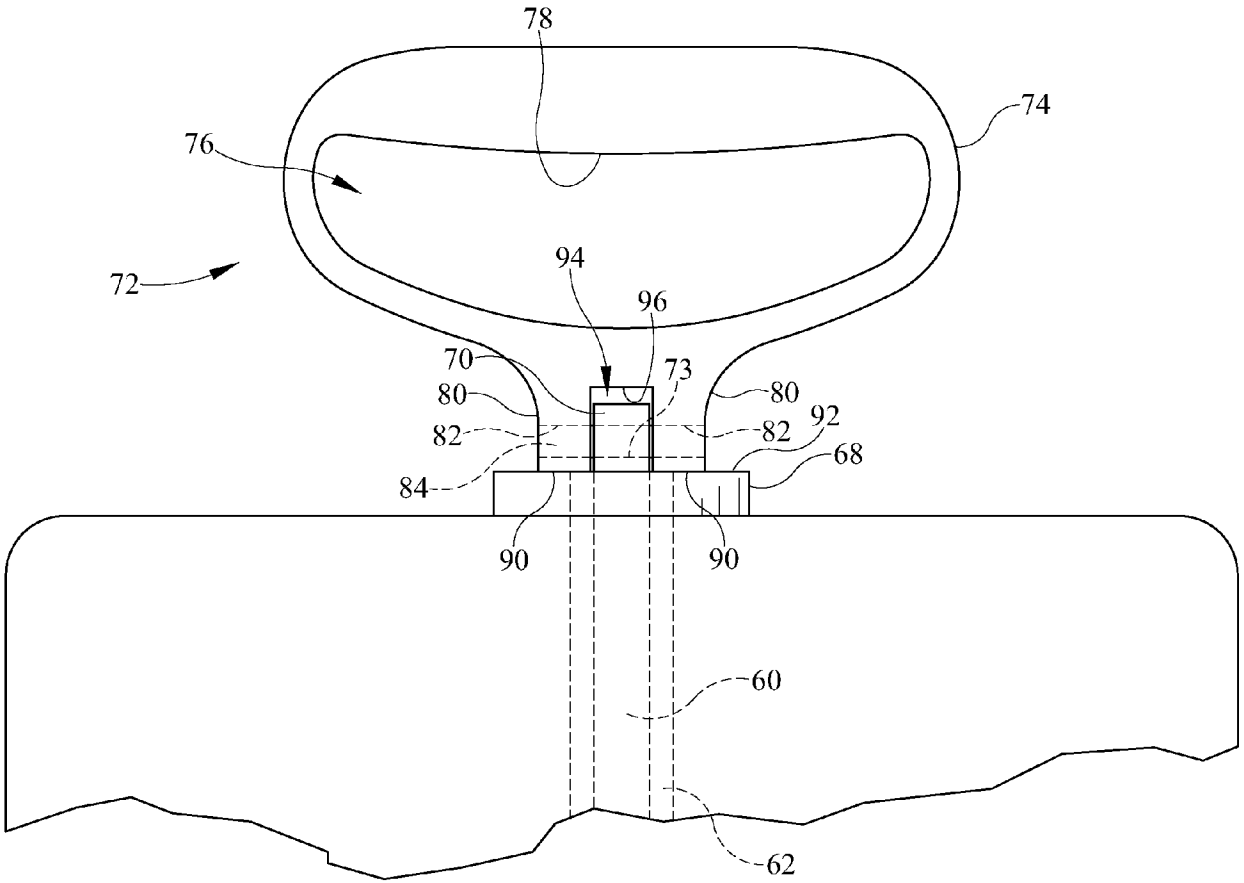
FIG. 5 is a side elevational view of the handle of the rotatable bag assembly of FIGS. 1-4.

The support shaft 60, as seen in FIGS. 3 and 4, includes an upper end 70 that supports a rotatable handle member 72. The upper end 70 end of the support shaft 60 further includes a cylindrical channel 73 through the support shaft 60, as will be discussed in greater detail below. Referring to FIGS. 3-5, the handle member 72 includes a generally oval-shaped handle 74 with an aperture 76 extending through the handle 74. The handle 74 provides a grasping surface 78, which can be grasped by a user to rotate the handle 74, as discussed in greater detail hereinafter. The handle member 72 further includes two downwardly extending U-shaped members 80 having cylindrical channels 82 through the members 80, as best seen in FIG. 5. When the handle member 72 is attached to the support shaft 60, the U-shaped members 80 straddle the upper end 70 of the support shaft 60 such that a pin 84 can be inserted through the channels 82 through the U-shaped members 80 and the channel 73 through the support shaft 60 to retain the handle 72 on the upper end 70 of the support shaft 60. When assembled, curved lower ends 90 of the U-shaped members 80 abut an upper surface 92 of the annular flange 68 at the upper end 66 of the tubular member 62. In addition, a gap 94 is formed between the upper end 70 of the support shaft 60 and a lower surface 96 of the handle 74 between the U-shaped members 80.

During use, the handle member 72 may be rotated from a first, upright position, as seen in FIG. 3, to a second position, as seen in FIG. 4, that is about 90 degrees from the first position. Although the handle member 72 is shown as being rotated 90 degrees to one side, the arrows in FIGS. 3 and 4 indicate that the handle member 72 may be rotated 90 degrees in either direction in order to function in the manner described below. In particular, when the handle member 72 is rotated to either side, the upper surface 92 of the annular flange 68 provides a camming surface for the curved lower ends 90 of the U-shaped members 80. More specifically, camming action between the upper surface 92 and the lower ends 90 allows the handle member 72 to be rotated along the upper surface 92 until a side surface 98 of the handle member 72 is disposed adjacent the upper surface 92. During this movement, the support shaft 60 is moved upwardly along a longitudinal axis 26 of the bag assembly 20 (away from the support plate 24) (see FIG. 4), thereby moving the suction cup member 34 upwardly along the longitudinal axis 26 (away from the support plate 24) and allowing the suction cup member 34 to be attached to a surface 100. When the handle member 72 is rotated back to the first position (FIG. 3), the support shaft 60 is moved downwardly along the longitudinal axis 26 of the bag assembly 20 (toward the support plate 24), thereby releasing the suction cup member 34 from attachment to the surface 100.

In another embodiment, the support shaft 60 (with or without a handle member 72) may be twisted to move the support shaft along the longitudinal axis 26 away from the support plate 24. For example, the support shaft 60 and the tubular member 62 could be threaded or the support shaft 60 and support plate 24 could be threaded in any manner known in the art. Still optionally, the support shaft 60 may be moved along the longitudinal axis 26 in any manner known in the art.

Figure 2:
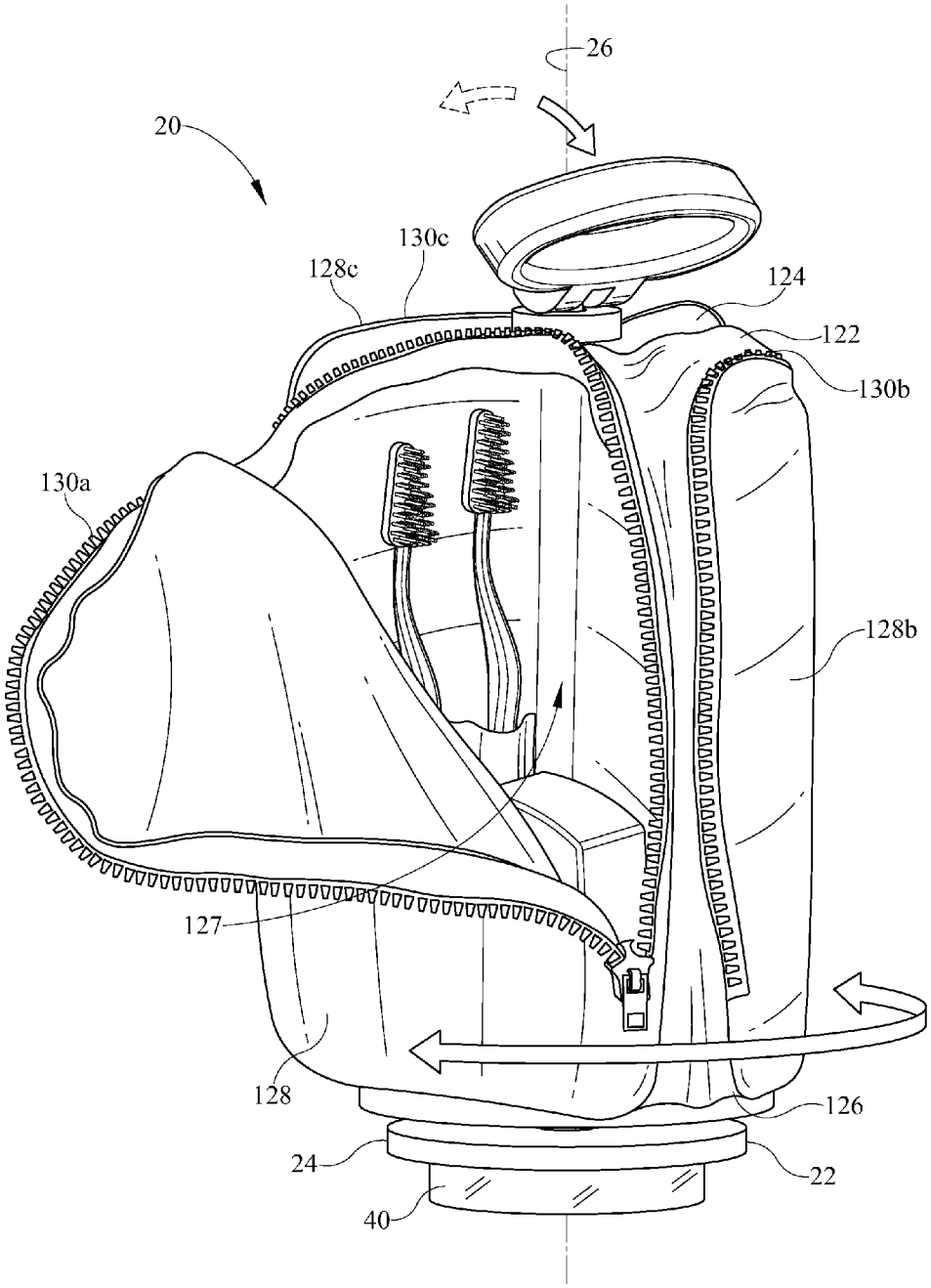
FIG. 2 is a top, isometric view of the bag assembly with rotatable bag of FIG. 1 with the handle in a second position rotated about 90 degrees from the first position.

A bag member 122 is shown in FIGS. 1 and 2 as being attached to the support shaft 60, tubular member 62, and/or support plate 24. The bag member 122 includes a generally planar and flexible top wall 124, a generally planar and flexible bottom wall 126, and three generally planar and flexible side walls **128*a*-128*c* extending between the top and bottom walls 124, 126 and forming a compartment 127. The side walls 128*a*-128*c* generally have a triangular cross-sectional shape in a plane perpendicular to a longitudinal axis 26 of the bag assembly 20 and each includes a zipper 130*a*-130*c* for accessing contents of the bag assembly 20**.

The bag member 122 may be made of any material known in the art, for example, cotton, polyester, leather, rayon, or any other generally flexible material, and combinations thereof. In addition, although the bag member 122 is shown as having a generally triangular cross-section, the bag member 122 may have any cross-sectional shape, such as rectangular, square-shaped, circular, oval, pentagonal, octagonal, and the like. Still further, although the bag member 122 is shown as having three walls **128*a*-128*c* and zippers 130*a*-130*c* and a single compartment 127, the bag member 122 may include any number of walls, zippers, and/or compartments. For example, in one embodiment, a bag member includes upper and lower compartments having a generally square shape with four walls. The bag member includes a zipper for each compartment on each wall for a total of 8 zippers. In a further embodiment, a bag member has a circular cross-section with first and second semi-circular compartments each comprising half of a horizontal area of the bag member and extending a full height of the bag. Each compartment includes a generally U-shaped zipper similar to the zippers 130*a*-130*c*** described above. As can be seen from the foregoing embodiments, numerous different embodiments are contemplated without departing from the scope of the present disclosure.

Although the bag member 122 is shown in FIGS. 1 and 2 as being disposed above or on top of the base member 22, the bag member 122 may extend downwardly past the base member 22 to cover the support plate 24 and suction cup member 34. Further, as seen in FIGS. 1 and 2, the annular nature of the suction cup member 34 and the wall 40 extending from the central suction cup 36, as well as the attachment of the annular projection 46 within the annular groove 30 of the base member 22, allow rotation of the bag member 122. In particular, the bag member 122 rotates with the support shaft 60, the tubular member 62, and the support plate 24 while the suction cup member 34 remains stationary. In another embodiment, the support plate 24 and the suction cup member 34 remain stationary and the bag member 12, the support shaft 60, and the tubular member 62 are be rotated. In yet another embodiment, the bag member 122, the tubular member 62, and the support plate 24 rotate while the support shaft 60 and suction cup member 34 remain stationary. As one skilled in the art will recognize, there are other ways to allow rotation of the bag member 122.

Figure 7:
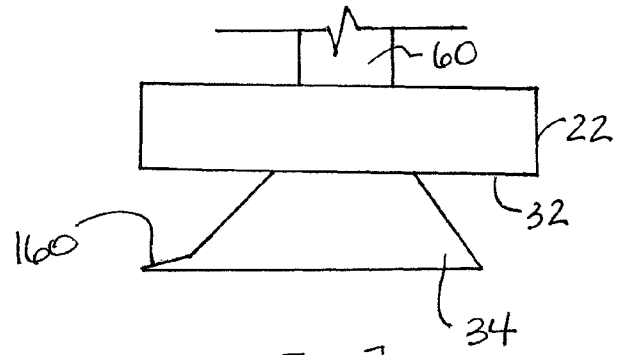
FIG. 7 is a side elevational view depicting another embodiment of a mechanism by which to attach the bag assembly to a surface.
Figure 6:
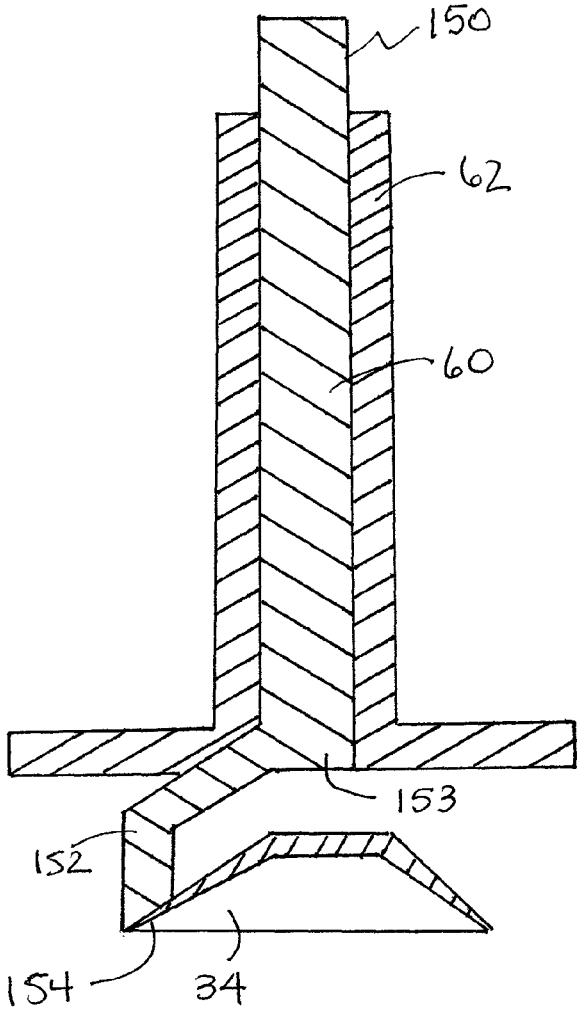
FIG. 6 is a cross-sectional view similar to that of FIG. 3 and depicting a further embodiment of the bag assembly having a different mechanism by which to attach the bag assembly to a surface.

FIGS. 6 and 7 depict further mechanisms for attaching the bag assembly 20 to the surface 100. Similar to previous embodiments, the tubular member 62 surrounds the support shaft 60. The support shaft 60 of FIG. 6 includes an end 150 that can be grasped and pulled by a user. In other embodiments, the end 150 includes a handle or other means to aid in grasping the shaft 60. An arm 152 connects an end 153 of the support shaft 60 and an outer edge 154 of the suction cup member 34. To attach the suction cup member 34 to the surface 100, a user pushes downwardly on the end 150, and thus, the support shaft 60 and the suction cup member 34. In order to detach the suction cup member 34 from the surface 100, a user pulls upwardly on the end 150, which pulls the support shaft 60 upwardly, thus pulling the arm 152 and the outer edge 154 of the suction cup member 34 upwardly and detaching the suction cup member 34 from the surface 100.

Referring to FIG. 7, the support shaft 60 extends upwardly from the base member 22 and the tubular member 62 is omitted. In addition, the suction cup member 34 is attached directly to the lower surface 32 of the base member 22. The suction cup member 34 includes a tab 160 or other member to aid in detaching the suction cup member 34 from the surface 100.

Any of the embodiments described herein may be modified to include any of the structures or methodologies disclosed in connection with other embodiments.

Further, although directional terminology, such as front, back, upper, lower, etc. may be used throughout the present specification, it should be understood that such terms are not limiting and are only utilized herein to convey the orientation of different elements with respect to one another.

Numerous modifications to the present disclosure will be apparent to those skilled in the art in view of the foregoing description. Accordingly, this description is to be construed as illustrative only and is presented for the purpose of enabling those skilled in the art to make and use the disclosure and to teach the best mode of carrying out same. The exclusive rights to all modifications which come within the scope of the appended claims are reserved.

I claim:

1. A bag assembly, comprising:

a base member having a suction cup configured to be releasably coupled to a horizontal surface to maintain a position of the bag assembly with respect to the surface;

a support member attached to and extending outwardly from the base member; and a bag member disposed adjacent the support member and having at least one compartment, the compartment having at least two openings for access into the compartment;

wherein the bag member rotates about the support member to access the at least two openings, wherein the support member is attached at a first end to the base member and attached at a second end to a handle member wherein the handle coupled to the support member has a first position and a second position such that when the handle is in the first position, the handle causes the suction cup to secure the bag assembly to the surface and, when the handle is in the second position, the handle causes the suction cup to release the bag assembly from the surface.

2. The bag assembly of claim 1, wherein the bag member includes two compartments and each of the openings allows access into one of the compartments.

3. The bag assembly of claim 2, wherein each of the openings includes a zipper for selectively opening and closing the openings.

4. The bag assembly of claim 1, wherein the bag member extends over the base member to cover the base member.

5. A method of providing a bag assembly, the method including the steps of:

providing a base member having a suction cup, a support shaft attached to and extending outwardly from the base member, and a bag member disposed adjacent the support shaft and having at least one compartment, the at least one compartment having at least two openings for access into the compartment;

attaching a first end of the support member to the base member and providing a handle member at a second end of the support member allowing for releasable coupling of the base member to a horizontal surface to maintain a position of the bag assembly with respect to the surface;

allowing the handle to cause the suction cup to secure the bag assembly to a horizontal surface when in a first position and allowing the handle to release the bag assembly from the horizontal surface when in a second position; and allowing the bag member to rotate about the support shaft to access the at least two openings.

* * * * *